US008353692B2

(12) United States Patent
Mori et al.

(10) Patent No.: US 8,353,692 B2
(45) Date of Patent: Jan. 15, 2013

(54) SCROLL TYPE COMPRESSOR

(75) Inventors: Hidefumi Mori, Kariya (JP); Masao Iguchi, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 534 days.

(21) Appl. No.: 12/712,344

(22) Filed: Feb. 25, 2010

(65) Prior Publication Data

US 2010/0221135 A1 Sep. 2, 2010

(30) Foreign Application Priority Data

Feb. 27, 2009 (JP) ..... 2009-047209

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/55.3; 418/55.1; 418/55.2; 418/55.5

(58) Field of Classification Search ..... 418/55.1–55.6
See application file for complete search history.

(56) References Cited

U.S. PATENT DOCUMENTS

| | | | | |
|---|---|---|---|---|
| 5,542,829 | A | 8/1996 | Inagaki et al. | |
| 6,331,102 | B1 * | 12/2001 | Takeuchi et al. | 418/55.3 |

FOREIGN PATENT DOCUMENTS

| | | | |
|---|---|---|---|
| JP | 62-199983 | A | 9/1987 |
| JP | 07-167067 | A | 7/1995 |
| JP | 08-049671 | A | 2/1996 |
| JP | 2005-155577 | A | 6/2005 |

* cited by examiner

*Primary Examiner* — Zelalem Eshete
(74) *Attorney, Agent, or Firm* — Yoshida and Associates, LLC

(57) ABSTRACT

A scroll type compressor has a housing, a rotary shaft, a fixed scroll member, a movable scroll member and a rotation preventing mechanism. The rotation preventing mechanism has a movable pin that is provided on the surface of movable end plate and extends toward end surface of the housing in parallel with an axis of the rotary shaft, a fixed pin that is provided on the end surface of the housing and extends toward the surface of the movable end plate in parallel with the axis of the movable pin, a rolling element that is disposed between the movable and the fixed pins, being contactable with the movable and the fixed pins and a retainer retaining the rolling element between the movable and the fixed pins.

10 Claims, 3 Drawing Sheets

SCROLL TYPE COMPRESSOR

BACKGROUND OF THE INVENTION

The present invention relates to a scroll type compressor having a fixed scroll member and a movable scroll member which is adapted to make an orbital motion while being prevented from rotating on its axis by a rotation preventing mechanism whereby a compression chamber whose volume is variable is formed between the fixed scroll member and the movable scroll member.

In general, a scroll type compressor includes a fixed scroll member having a fixed end plate and a fixed scroll wall and a movable scroll member having a movable end plate and a movable scroll wall. The fixed and the movable scroll members are disposed in a housing with the scroll walls thereof engaged with each other. The movable scroll member orbits around the axis of the fixed scroll member and refrigerant gas taken into a compression chamber defined between the fixed and the movable scroll walls of the scroll members is compressed with a decrease in the volume of the compression chamber in accordance with the orbital motion of the movable scroll member.

The scroll type compressor has a rotation preventing mechanism that prevents the rotation of the movable scroll member and allows the movable scroll member to orbit around the axis of the fixed scroll member Japanese Patent Application Publication H7-167067 discloses a rotation preventing mechanism. The rotation preventing mechanism includes a plurality of movable pins provided on the end surface of the movable scroll member for orbiting in accordance with orbital motion of the movable scroll member and a plurality of fixed pins provided on the end surface of a casing forming a part of the fixed scroll member for contact engagement with the movable pins. When the movable scroll member orbits around the axis of the fixed scroll member, each movable pin of the movable scroll member orbits around its paired fixed pin of the fixed scroll member. Contact engagement of the paired movable and fixed pins allows the movable scroll member to make an orbiting motion while being prevented from rotating on its axis.

In the rotation preventing mechanism of the above Publication, the movable pins and the fixed pins are fixed to the end surface of the movable scroll member and the casing, respectively, by press fitting. A force acting on the movable scroll member for rotation on its axis is transmitted to each fixed pins due to the contact engagement thereof with its paired movable pin and further to the casing. With the fixed and the movable pins in contact engagement with each other, sliding contact arises in the movable pin and/or fixed pin and friction resistance due to the sliding contact arises therebetween. Accordingly, there has been problems that the power loss increases in the scroll type compressor and both movable and fixed pins are subject to wear.

The present invention is directed to providing a scroll type compressor that can reduce the friction resistance between the movable and the fixed pins and the wear of the pins.

SUMMARY OF THE INVENTION

A scroll type compressor has a housing, a rotary shaft, a fixed scroll member, a movable scroll member and a rotation preventing mechanism. The rotation preventing mechanism has a movable pin that is provided on the surface of movable end plate and extends toward end surface of the housing in parallel with an axis of the rotary shaft, a fixed pin that is provided on the end surface of the housing and extends toward the surface of the movable end plate in parallel with the axis of the movable pin, a rolling element that is disposed between the movable and the fixed pins, being contactable with the movable and the fixed pins and a retainer retaining the rolling element between the movable and the fixed pins.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which;

DETAILED DESCRIPTION OF THE. PREFERRED EMBODIMENTS

Figure 1:
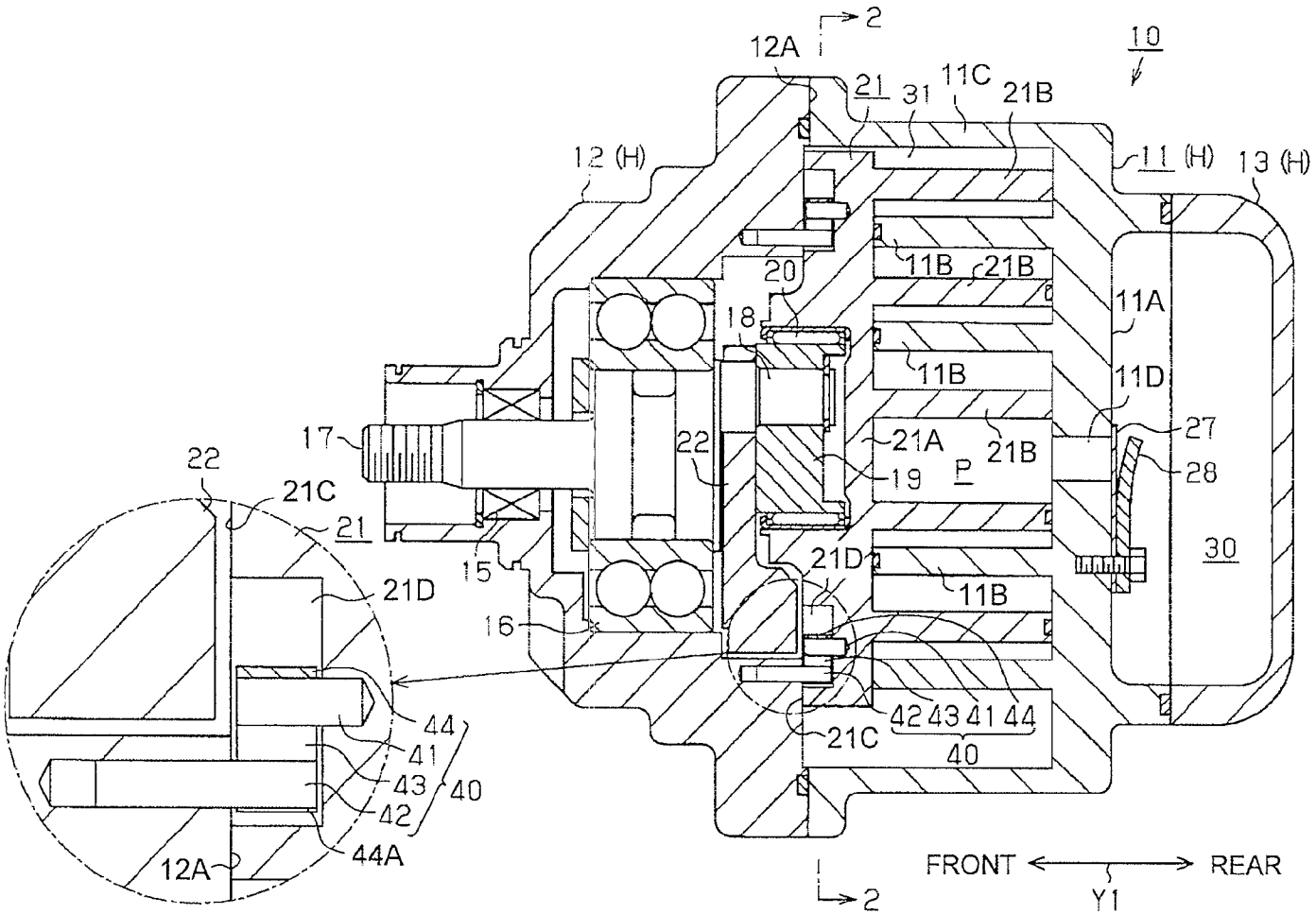
FIG. 1 is a longitudinal cross-sectional view of a scroll type compressor according to a first embodiment of the present invention.

The following will describe the first embodiment of a scroll type compressor used for a vehicle air conditioner according to the present invention with reference to FIGS. 1 and 2. In the following description, the references to directions of front and rear are indicated by arrow Y1 in FIG. 1.

As shown in FIG. 1, the scroll type compressor 10 (hereinafter simply referred to as a compressor) includes a front housing 12, a rear housing 13 and a fixed scroll member 11 serving also as a center housing of the compressor 10. The front and rear ends of the fixed scroll member 11 are fixed to the rear end of the front housing 12 and the front end of the rear housing 13, respectively. The fixed scroll member 11, the front housing 12 and the rear housing 13 are made of an aluminum alloy and cooperate to form a housing H of the compressor 10.

The fixed scroll member 11 includes a disk-shaped fixed end plate 11A, a fixed scroll wall 11B extending frontward from the front surface of the fixed end plate 11A and a fixed peripheral wall 11C extending frontward from the periphery of the front surface of the fixed end plate 11A. As shown in FIG. 1, the walls 11A, 11B, 11C are made integrally thereby to form the fixed scroll member 11. A rotary shaft 17 is rotatably supported through a seal device 15 and a bearing 16 in the front housing 12. The rotary shaft 17 has an integral eccentric pin 18 that is offset from the center axis of the rotary shaft 17 and extends from the rear end surface of the rotary shaft 17. The eccentric pin 18 is fitted in a bush 19. A movable scroll member 21 is rotatably supported by the bush 19 through a bearing 20 and a counterweight 22 is fixed to the bush 19.

The movable scroll member 21 includes a disk-shaped movable end plate 21A supported by the bearing 20 and a movable scroll wall 21B extending toward the fixed scroll member 11 from the rear surface of the movable end plate 21A, facing the fixed scroll member 11. The movable scroll wall 21B of the movable scroll member 21 engages with the fixed scroll wall 11B of the fixed scroll member 11 thereby to define therebetween compression chambers P.

The fixed end plate 11A of the fixed scroll member 11 has formed therethrough at the center thereof a discharge port 11D, which is opened and closed by a discharge valve 27. Opening degree of the discharge valve 27 is regulated by a retainer 28 fixed to the fixed end plate 11A. The fixed end plate 11A of the fixed scroll member 11 and the rear housing 13 define therebetween a discharge chamber 30 that is communicable through the discharge port 11D with the innermost compression chamber P.

The fixed peripheral wall 11C of the fixed scroll member 11 and the periphery of the movable scroll wall 21B of the movable scroll member 21 define therebetween a suction chamber 31. Refrigerant gas drawn into the suction chamber 31 through a suction port (not shown) formed in the front housing 12 flows therefrom into the compression chambers P.

Figure 2A:
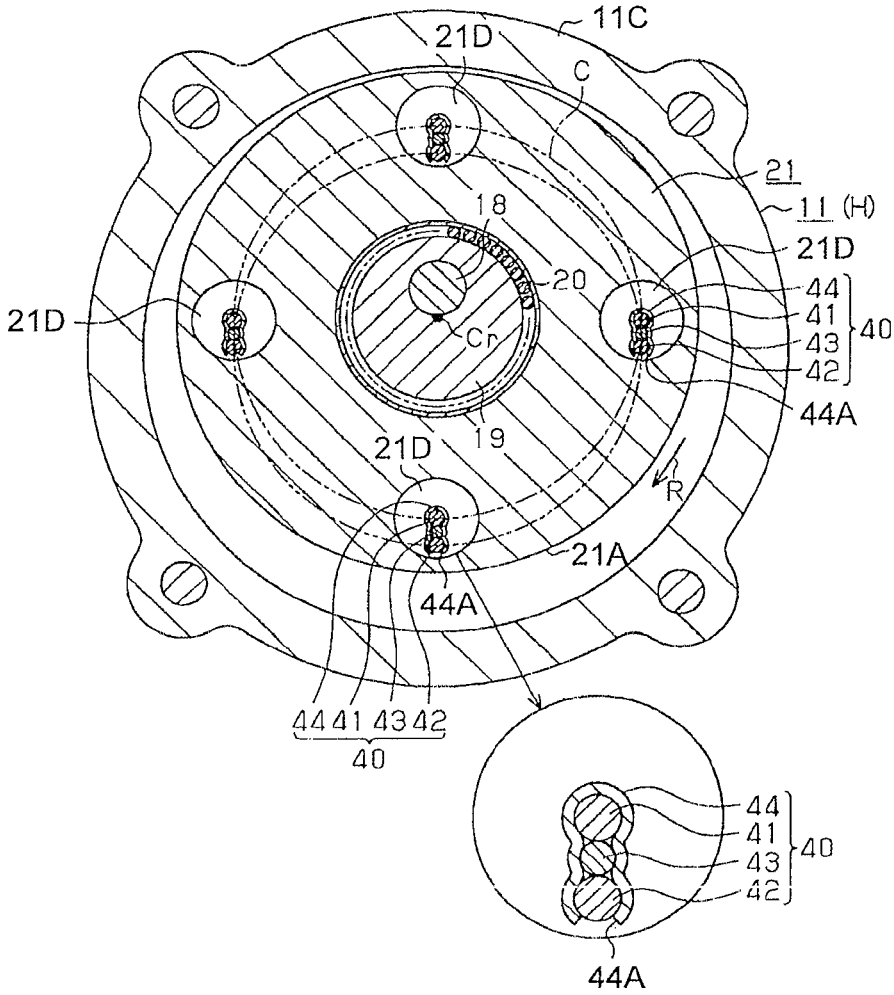
FIG. 2A is a cross-sectional view taken along the line 2-2 of FIG. 1, showing a rotation preventing mechanism in the scroll type compressor

The following will describe a rotation preventing mechanism 40 of the compressor 10. A plurality of circular holes 21D are formed in the front end surface 21C of the movable end plate 21A that is opposite from the end surface where the movable scroll wall 21B is formed. As shown in FIGS. 1 and 2A, the circular holes 21D are formed concentrically at four positions that are spaced at an equiangular interval. A column-shaped movable pin 41 extends from the center of the bottom surface of each circular hole 21D toward the rear end surface 12A of the front housing 12 that faces the front end surface 21C of the movable scroll member 21. Each movable pin 41 is fixed to the movable end plate 21A by press-fitting and disposed in the hole 21D in parallel with the axis of the rotary shaft 17 so that the front end of the movable pin 41 may not extend beyond the front end surface 21C of the movable end plate 21A in longitudinal direction.

Column-shaped fixed pins 42 of the front housing 12 are provided concentrically at four positions on the rear end surface 12A of the front housing 12 that are spaced at an equiangular interval, respectively. Each fixed pin 42 extends from the front housing 12 toward the movable scroll member 21 and enters into its corresponding hole 21D. Each fixed pin 42 is fixed to the front housing 12 by press-fitting. The diameter of the fixed pin 42 is substantially the same as that of the movable pin 41. Each fixed pin 42 is disposed in the hole 21D in parallel with the axis of the rotary shaft 17 so that the front end of the fixed pin 42 may not contact with the bottom surface of the hole 21D. In other words, the fixed pin 42 is also in parallel with the axis of the movable pin 41.

A column-shaped pin 43 as a rolling element is disposed between the movable and the fixed pins 41, 42, and the movable pin 41, the fixed pin 42 and the pin 43 are retained together in a retainer 44. The diameter of the column-shaped pin 43 is smaller than those of the movable and the fixed pins 41, 42. The length of the pin 43 is slightly shorter than the depth of the hole 21D.

Figure 2B:
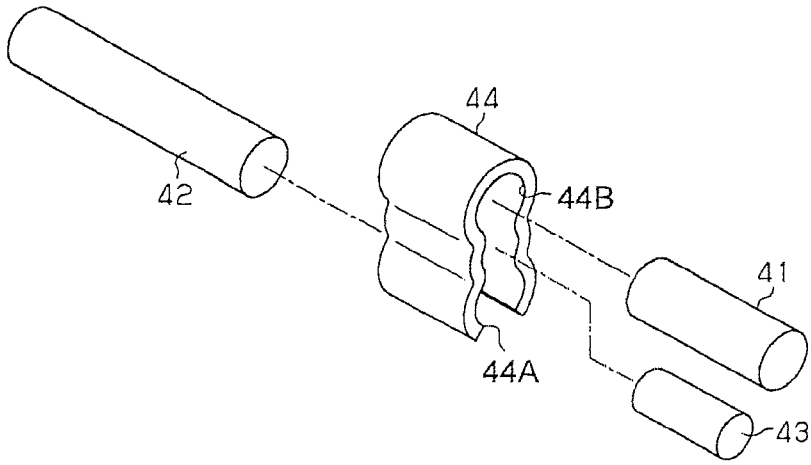
FIG. 2B is an exploded perspective view showing the rotation preventing mechanism of FIG. 2A.

As shown in FIGS. 2A and 2B, the retainer 44 is made of a metal (e.g., iron or aluminum) and wholly formed into a U-shape in cross section having an opening 44A at one end thereof and elastically deformable so as to expand the opening 44A. The retainer 44 is open at the opposite ends thereof as viewed in a direction perpendicular to the cross section of FIG. 2A and has an insertion hole 44B, as shown in FIG. 2B. The movable pin 41, the fixed pin 42 and the pin 43 can be inserted through the insertion hole 44B of the retainer 44.

The retainer 44 retains the movable pin 41, the fixed pin 42 and the pin 43 in such a way that the fixed pin 42 is located close to the opening 44A and the pin 43 is contactable with each of the movable and the fixed pins 41, 42. The retainer 44 contactably surrounds the outer circumference of the movable pin 41, the fixed pin 42 and the pin 43 together in the hole 21D and a part of the surface of the fixed pin 42 is exposed outside the retainer 44 from the opening 44A. The opening 44A of the retainer 44 and a part of the fixed pin 42 exposed from the opening 44A face the inner surface of the hole 21D.

Furthermore, the retainer 44 retains the movable pin 41, the fixed pin 42 and the pin 43 in such a state that the retainer 44 is elastically deformed to expand the opening 44A. With the retainer 44 pressed against the movable pin 41, the fixed pin 42 and the pin 43 by its elastic force to return the retainer 44 to its original shape, the movable pin 41, the fixed pin 42 and the pin 43 are retained in a line as viewed radially of the pins in this order, as shown in enlarged view of FIG. 2A. The movable pin 41, the fixed pin 42, the pin 43 and the retainer 44 cooperatively form the rotation preventing mechanism 40 in the embodiment.

The following will describe the operation of the rotation preventing mechanism 40 of the compressor 10. When the rotary shaft 17 of the compressor 10 is rotated by an external driving source such as an engine, the movable scroll member 21 orbits through the eccentric shaft 18 in arrow direction R shown in FIG. 2A. Accordingly, the movable pin 41 orbits around the fixed pin 42. Since the movable pin 41, the fixed pin 42 and the pin 43 are retained in the retainer 44, the pin 43 rolls between the movable and the fixed pins 41, 42 while being in contact with the movable and the fixed pins 41, 42.

As shown in FIG. 2A, when the movable pin 41 is located above the fixed pin 42, the movable scroll member 21 tends to rotate in the arrow direction R along a circle C relative with center Cr as the center of rotation and the movable pin 41 orbits around the fixed pin 42. On the right side with Cr as the center in FIG. 2A, a force tending to rotate the movable scroll member 21 acts downward along the circle C. Then, the movable pin 41 located on the right side in FIG. 2A is pressed against the pin 43 located under the movable pin 41. Since the pin 43 rotates in accordance with the orbital motion of the movable scroll member 21, the pins 41, 43 roll in contact with each other.

The pin 43 that receives a force from the movable pin 41 is pressed against the fixed pin 42. Since the pin 43 rotates in accordance with the orbital motion of the movable scroll member 21, the fixed pin 42 and the pin 43 roil and contact each other. Then, the force tending to rotate the movable scroll member 21 is received by the front housing 12 through the fixed pin 42. Therefore, the force tending to rotate the movable scroll member 21 is received by the front housing 12 through the movable pin 41, the pin 43 and the fixed pin 42 thereby to permit the movable scroll member 21 to make orbital motion while being prevented from rotating on its axis.

On the other hand, the force tending to rotate the movable scroll member 21 and therefore directed upward along the circle C acts on the movable pin 41 located on the left side with Cr as the center in FIG. 2A. The movable pin 41, which is located above the center Cr, receives a force tending to rotate the movable scroll member 21 in arrow direction R. The force tending to rotate the movable pin 41 does not act on the pin 43 located under the movable pin 41 and, therefore, the force tending to rotate the movable scroll member 21 does not act on the front housing 12 through the fixed pin 42.

The following advantageous effects are obtained according to the above embodiment.

(1) The pin 43 is provided between the movable pin 41 fixed to the movable scroll member 21 and the fixed pin 42 fixed to the fixed scroll member 11 and the movable pin 41, the pin 43 and the fixed pin 42 are retained together by the retainer 44. The force tending to rotate the movable scroll member 21 acts on the movable pin 41 and is then transmitted to the pin 43 through the rolling contact between the movable pin 41 and the pin 43 and further to the front housing 12 via the fixed pin 42 through the rolling contact between the fixed pin 42 and the pin 43. As compared with the case in which the force tending to rotate the movable scroll member 21 is transmitted through the sliding contact between the movable pin 41 and the pin 42, the frictional resistance between the pin 43 and each of the movable and the fixed pins 41, 42 can be reduced and, accordingly, the power loss of the compressor 10 can be reduced, and furthermore the abrasion of the movable and the fixed pins 41, 42 can be reduced.

(2) The movable pin 41, the pin 43 and the fixed pin 42 are retained by the retainer 44 in a line as viewed radially of the pins. Therefore, it is difficult to transmit the force from the pin 43 to the retainer 44 and the force tending to rotate the movable scroll member 21 can be transmitted to the front housing 12 without fail.

(3) The rotation preventing mechanism 40 is formed by the movable pin 41, the fixed pin 42 and the pin 43. It is easy to manufacture a pin precisely thereby to secure smaller dimensional tolerance. Therefore, the clearance between the inner surface of the hole 21D and the outer circumference of the fixed pin 42 facing the inner surface of the hole 21D can be designed with high precision. Furthermore, since the dimensional tolerance of each of the movable pin 41, the pin 43 and the fixed pin 42 can be set smaller, the dimensional tolerance of the rotation preventing mechanism including the movable pin 41, the fixed pin 42 and the pin 43 can be reduced, accordingly. Therefore, the orbital motion error of the movable scroll member 21 caused by any clearance error can be reduced and, accordingly, noise and vibration of the compressor can be reduced.

(4) The rotation preventing mechanism 40 is formed by the movable pin 41, the fixed pin 42 and the pin 43. Since a pin can be manufactured precisely and inexpensively in large amounts, the use of such pins for the rotation preventing mechanism is advantageous in that the manufacturing cost of the rotation preventing mechanism 40 can be kept low.

(5) The retainer 44 is formed with the opening 44A and the movable pin 41, the pin 43 and the fixed pin 42 are retained by the retainer 44 in such a way that a part of surface of the fixed pin 42 is exposed outside the retainer 44 from the opening 44A. Since the cross section of the retainer 44 is not circular but U-shaped, the dimension in the radial direction of the retainer 44 is reduced by the length corresponding to the thickness thereof. In other words, the radius of the hole 21D facing the fixed pin 42 can be reduced by the length corresponding to the thickness of the retainer 44.

(6) A column shaped member is used for the pin 43. Since the pin 43 makes surface contact with each of the movable and the fixed pins 41, 42, the force can be transmitted efficiently.

(7) The retainer 44 has the opening 44A and can be deformed elastically due to the presence of the opening 44A thereby to allow the movable pin 41, the pin 43 and the fixed pin 42 to be spaced apart each other while the movable scroll member 21 orbits. Only when the movable pin 41, the pin 43 and the fixed pin 42 are pressed against each other, the rotation preventing mechanism 40 functions to prevent the movable scroll member 21 from rotating on its axis, and the rest of the time, it does not prevent the movable scroll member 21 from rotating. Since the movable pin 41 and the pin 43 can be spaced apart each other, there is no need to manufacture the retainer 44 undeformably rigid and precisely, so that the manufacturing cost of the retainer 44 can be reduced.

(8) The movable and the fixed pins 41, 42 are formed with substantially the same diameter. Therefore, when each of the movable and the fixed pins 41, 42 rolls in contact with the pin 43, the orbital angular velocity of the movable pin 41 corresponds to that of the pin 43. Thus, slippage between the pin 43 and each of the moveable and the fixed pins 41, 42, respectively, can be avoided.

Figure 3A:
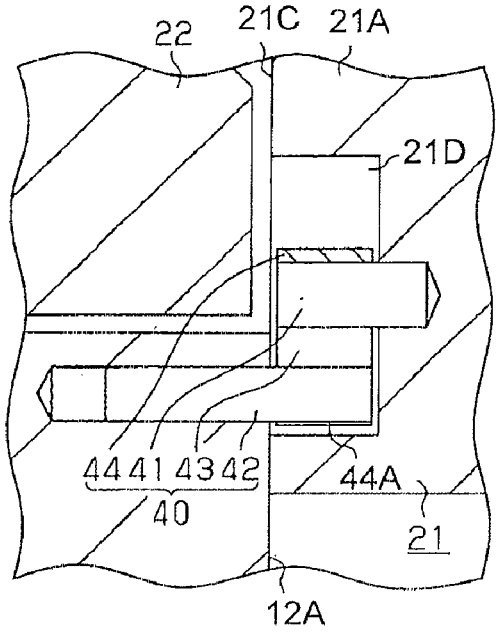
FIG. 3A is a fragmentary partially enlarged longitudinal cross-sectional view showing a rotation preventing mechanism according to a second embodiment of the present invention and FIG. 3B is a cross sectional view showing the rotation preventing mechanism of FIG. 3A.
Figure 3B:
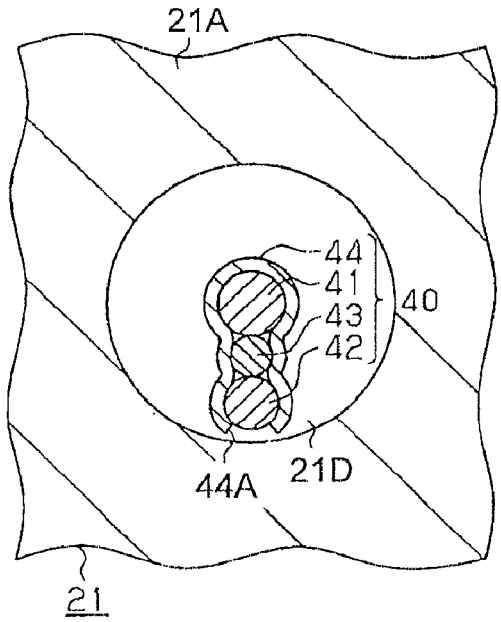

The following will describe the second embodiment according to the present invention with reference to FIG. 3. The following description will use the same reference numbers for the common elements or components in both of the first and the second embodiments, and the description of such elements and components in FIG. 3 for the second embodiment will be omitted.

As shown in FIG. 3A, the movable pin 41 has a diameter that is larger than that of the fixed pin 42. According to the second embodiment, the following additional advantageous effect can be obtained in addition to the effects (1) through (7) according to the first embodiment.

(8) While the movable pin 41, the pin 43 and the fixed pin 42 are orbiting while being pressed against each other, the pin 43 tends to orbit faster than the movable pin 41. Therefore, delay of the pin 43 in orbital direction can be prevented. When the pin 43 contacts with the leading side of the retainer 44 as viewed in the orbital direction, the pin 43 slips slightly relative to the movable pin 41 and the movement of the pin 43 in the orbital direction of the movable scroll member 21 is restrained.

The above embodiments may be modified as follows. A spherical member may be used as a rolling element. The use of the spherical member helps to manufacture the rolling element precisely and inexpensively and to keep the manufacturing cost of the rotation preventing mechanism 40 low.

Figure 4:
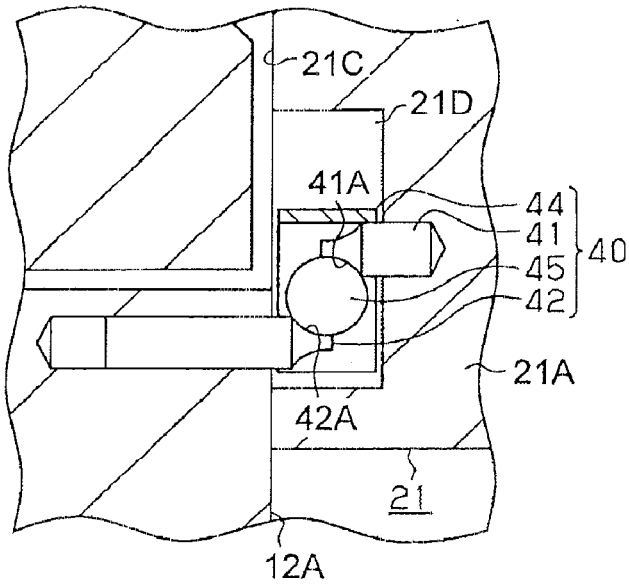
FIG. 4 is a fragmentary partially enlarged longitudinal cross-sectional view showing a rotation preventing mechanism according to an alternative embodiment of the present invention.

As shown in FIG. 4, recessed portions 41A, 42A may be formed in the periphery of the distal end of the movable and the fixed pins 41, 42, respectively, and a ball 45 as a rolling element may be provided between the recessed portions 41A, 42A of the movable and the fixed pins 41, 42. The recessed portions 41A, 42A are formed with a spherical surface that is complementary to the spherical surface of the ball 45. The ball 45 is supported in contact with each of the recessed portions 41A, 42A and rolls therebetween in accordance with the orbital motion of the movable scroll 21.

In this structure, when the movable pin 41 orbits in accordance with the orbital motion of the movable scroll member 21, the ball 45 rolls in contact with the movable and the fixed pins 41, 42. As compared with the case in which the movable and the fixed pins 41, 42 slide in contact with the pin 43, the frictional loss and the abrasion of the movable and the fixed pins 41, 42 can be reduced. Furthermore, in the embodiment of FIG. 4 wherein the thrust load acting on the movable pin 41 from the movable scroll member 21 and the thrust load acting on the fixed pin 42 from the front housing 12 are received by the ball 45 in rolling contact with each of the movable and the fixed pins 41, 42, the frictional loss and the abrasion of the movable and the fixed pins 41, 42 can be reduced.

The retainer 44 may be formed without the opening 44A so as to surround the entirety of the movable pin 41, the pin 43 and the fixed pin 42.

The retainer 44 may be made of a synthetic resin.

The retainer 44 may be formed so as to cover the free ends of the movable and the fixed pins 41, 42 (or the ends that are opposite from the press-fitted ends). In other words, the retainer may have insertion holes 44B only at positions through which the movable pin 41, the pin 43 and the fixed pin 42 are inserted. The retainer 44 thus formed can be improved in strength.

A hole corresponding to the hole 21D may be formed in the rear surface of the front housing 12 and the fixed pin 42 may extend from the bottom surface of the hole. The movable pin 41 may extend into the hole from the front surface of the movable base wall 21A and the movable pin 41, the pin 43 and the fixed pin 42 may be retained by the retainer 44 in the hole of the front housing 12.

The insertion holes 44B of the retainer 44 that retain the movable and the fixed pins 41, 42 may be formed in an elongated hole so as to allow the movable pin 41, the pin 43 and the fixed pin 42 to be spaced apart each other.

What is claimed is:

1. A scroll type compressor comprising:

a housing having an end surface;

a rotary shaft;

a fixed scroll member including a fixed end plate and a fixed scroll wall formed on the fixed end plate and joined to the housing;

a movable scroll member including a movable end plate and a movable scroll wall formed on the movable end plate; and a rotation preventing mechanism, wherein the movable scroll member is adapted to make an orbital motion in accordance with the rotation of the rotary shaft while being prevented from rotating on its axis by the rotation preventing mechanism whereby a compression chamber whose volume is variable is formed between the fixed scroll member and the movable scroll member, wherein the rotation preventing mechanism includes:

a movable pin provided on the surface of the movable end plate that is opposite from the surface thereof where the movable scroll wall is formed, the movable pin extending toward the end surface of the housing in parallel with an axis of the rotary shaft;

a fixed pin provided on the end surface of the housing, the fixed pin extending toward the surface of the movable end plate in parallel with an axis of the movable pin;

a rolling element that is disposed between the movable and the fixed pins, being contactable with the movable and the fixed pins; and a retainer retaining the rolling element between the movable and the fixed pins.

2. The compressor according to claim 1, wherein the retainer allows the movable and the fixed pins and the rolling element to be spaced apart each other.

3. The compressor according to claim 1, wherein the diameter of the movable pin is the same as that of the fixed pin.

4. The compressor according to claim 1, wherein the diameter of the movable pin is larger than that of the fixed pin.

5. The compressor according to claim 1, wherein the retainer surrounds the outer circumference of the movable and the fixed pins and the rolling element and has an opening from which a part of the fixed pin is exposed outside the retainer, wherein the cross section of the retainer is formed in a U-shape.

6. The compressor according to claim 1, wherein the retainer is elastically deformable.

7. The compressor according to claim 1, wherein the rolling element is a column-shaped pin.

8. The compressor according to claim 1, wherein the retainer retains the fixed pin, the rolling element and the movable pin in a line as viewed radially of the pins in this order.

9. The compressor according to claim 1, wherein the rolling element is a spherical member.

10. The compressor according to claim 9, wherein the movable and the fixed pins have circular shape recessed portions in the periphery of the distal end thereof, respectively so that the rolling element is supported in contact with each of the recessed portions.

* * * * *